US009624920B2

(12) United States Patent
Chin et al.

(10) Patent No.: US 9,624,920 B2
(45) Date of Patent: Apr. 18, 2017

(54) PERISTALTIC PUMP SYSTEMS AND METHODS

(71) Applicant: Elwha, LLC, Bellevue, WA (US)

(72) Inventors: Hon Wah Chin, Palo Alto, CA (US); Roderick A. Hyde, Redmond, WA (US); Jordin T. Kare, Seattle, WA (US); Lowell L. Wood, Jr., Bellevue, WA (US)

(73) Assignee: ELWHA LLC, Bellevue, WA (US)

( * ) Notice: Subject to any disclaimer, the term of this patent is extended or adjusted under 35 U.S.C. 154(b) by 544 days.

(21) Appl. No.: 14/053,428

(22) Filed: Oct. 14, 2013

(65) Prior Publication Data

US 2015/0104329 A1 Apr. 16, 2015

(51) Int. Cl.

| | |
|---|---|
| ***F04B 43/12*** | (2006.01) |
| ***F04B 49/00*** | (2006.01) |
| ***F04B 23/04*** | (2006.01) |
| ***F04B 49/06*** | (2006.01) |

(52) U.S. Cl.

CPC ..... *F04B 43/123* (2013.01); *F04B 23/04* (2013.01); *F04B 49/007* (2013.01); *F04B 49/065* (2013.01); *F04B 43/12* (2013.01)

(58) Field of Classification Search

CPC ..... F04B 23/04; F04B 23/12; F04B 43/12; F04B 43/1215; F04B 43/123; F04B 49/065; F04B 49/103; F04B 49/106

See application file for complete search history.

(56) References Cited

U.S. PATENT DOCUMENTS

| | | | | |
|---|---|---|---|---|
| 2,617,362 A | | 11/1952 | Parsons | |
| 2,735,642 A | | 2/1956 | Norman | |
| 2,899,905 A | * | 8/1959 | Becher | F04B 43/0072 251/6 |
| 3,303,748 A | | 2/1967 | Duryee et al. | |
| 3,478,695 A | | 11/1969 | Goranson et al. | |
| 3,526,223 A | * | 9/1970 | Curtis | B64D 10/00 128/202.11 |

(Continued)

FOREIGN PATENT DOCUMENTS

| | | |
|---|---|---|
| FR | 1394047 | 12/1963 |
| GB | 1295953 A | 11/1972 |

OTHER PUBLICATIONS

A Comparison of the Application of Centrifugal and Positive Displacement Pumps. Proc. of Proceedings of the 17th International Pump Users Symposum, Texas A&M. N.p.: n.p., 2000. 145-52. Web. <http://turbolab.tamu.edu/proc/pumpproc/P17/P17145-152.pdf>.*

(Continued)

*Primary Examiner* — Devon Kramer
*Assistant Examiner* — Joseph Herrmann

(57) ABSTRACT

Staged peristaltic pump systems and related methods are disclosed. A system may be configured such that the working fluid pressure differential across any individual stage of the system is smaller than the pressure across the entire system. In some embodiments certain components of each stage may be sealed from fluid communication with an external environment, though working fluid may be configured to cross the boundary of the seal. In some embodiments, stages may be pressurized with respect to an external environment.

19 Claims, 7 Drawing Sheets

(56) References Cited

U.S. PATENT DOCUMENTS

| | | | | | |
|---|---|---|---|---|---|
| 3,674,383 | A * | 7/1972 | Iles | F04B 43/1238 | 417/476 |
| 3,687,580 | A | 8/1972 | Griffiths | | |
| 3,713,296 | A | 1/1973 | Black | | |
| 3,784,323 | A | 1/1974 | Sausse | | |
| 3,881,483 | A * | 5/1975 | Sausse | A61M 1/3621 | 210/110 |
| 4,116,589 | A | 9/1978 | Rishton | | |
| 4,278,085 | A * | 7/1981 | Shim | A61M 5/14232 | 128/DIG. 12 |
| 4,321,020 | A | 3/1982 | Mittal | | |
| 4,828,543 | A | 5/1989 | Weiss et al. | | |
| 4,856,972 | A * | 8/1989 | Van Benschoten | F04B 43/12 | 417/477.1 |
| 4,923,376 | A | 5/1990 | Wright | | |
| 4,965,713 | A * | 10/1990 | Hong | G05B 13/0265 | 417/18 |
| 4,997,347 | A | 3/1991 | Roos | | |
| 5,037,274 | A | 8/1991 | Holmes et al. | | |
| 5,049,045 | A | 9/1991 | Oklejas et al. | | |
| 5,281,112 | A | 1/1994 | Montoya et al. | | |
| 5,417,281 | A | 5/1995 | Wood et al. | | |
| 5,820,354 | A | 10/1998 | Wild et al. | | |
| 6,139,740 | A | 10/2000 | Oklejas | | |
| 6,171,082 | B1 | 1/2001 | Hankner et al. | | |
| 7,578,662 | B1 | 8/2009 | Ibragimov | | |
| 8,226,591 | B2 * | 7/2012 | Mazur | A61M 1/1037 | 604/4.01 |

OTHER PUBLICATIONS

Wikimedia Foundation, Inc., Progressive Cavity Pump, http://en.wikipedia.org/wiki/Progressive_cavity_pump, visited Oct. 16, 2013, 4 pgs.

Crane; "Flow of Fluids through Valves, Fittings and Pipe"; Technical Paper No. 410; 2013; 17 pages; Stamford.

* cited by examiner

PERISTALTIC PUMP SYSTEMS AND METHODS

If an Application Data Sheet (ADS) has been filed on the filing date of this application, it is incorporated by reference herein. Any applications claimed on the ADS for priority under 35 U.S.C. §§119, 120, 121, or 365(c), and any and all parent, grandparent, great-grandparent, etc. applications of such applications, are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 USC §119(e) for provisional patent applications, for any and all parent, grandparent, great-grandparent, etc. applications of the Priority Application(s)). In addition, the present application is related to the "Related Applications," if any, listed below.

PRIORITY APPLICATIONS

None

RELATED APPLICATIONS

U.S. patent application Ser. No. 14/053,430, entitled PERISTALTIC PUMP SYSTEMS AND METHODS, naming Hon Wah Chin, Roderick A. Hyde, Jordin T. Kare and Lowell L. Wood, Jr. as inventors, filed Oct. 14, 2013, is related to the present application.

TECHNICAL FIELD

The present disclosure relates generally to pumps, motors, or other systems configured to displace working fluid or to generate a mechanical output based on working fluid displacement. More particularly the present disclosure relates to peristaltic displacement systems—which may be operated as pumps or motors—including systems comprised of multiple stages serially disposed along a working fluid flow path.

BRIEF DESCRIPTION OF THE DRAWINGS

The embodiments disclosed herein will become more fully apparent from the following description and appended claims, taken in conjunction with the accompanying drawings. The drawings depict exemplary embodiments of the present disclosure. Various features of these embodiments will be described with additional specificity and detail through reference to the drawings, in which:

DETAILED DESCRIPTION

Figure 1:
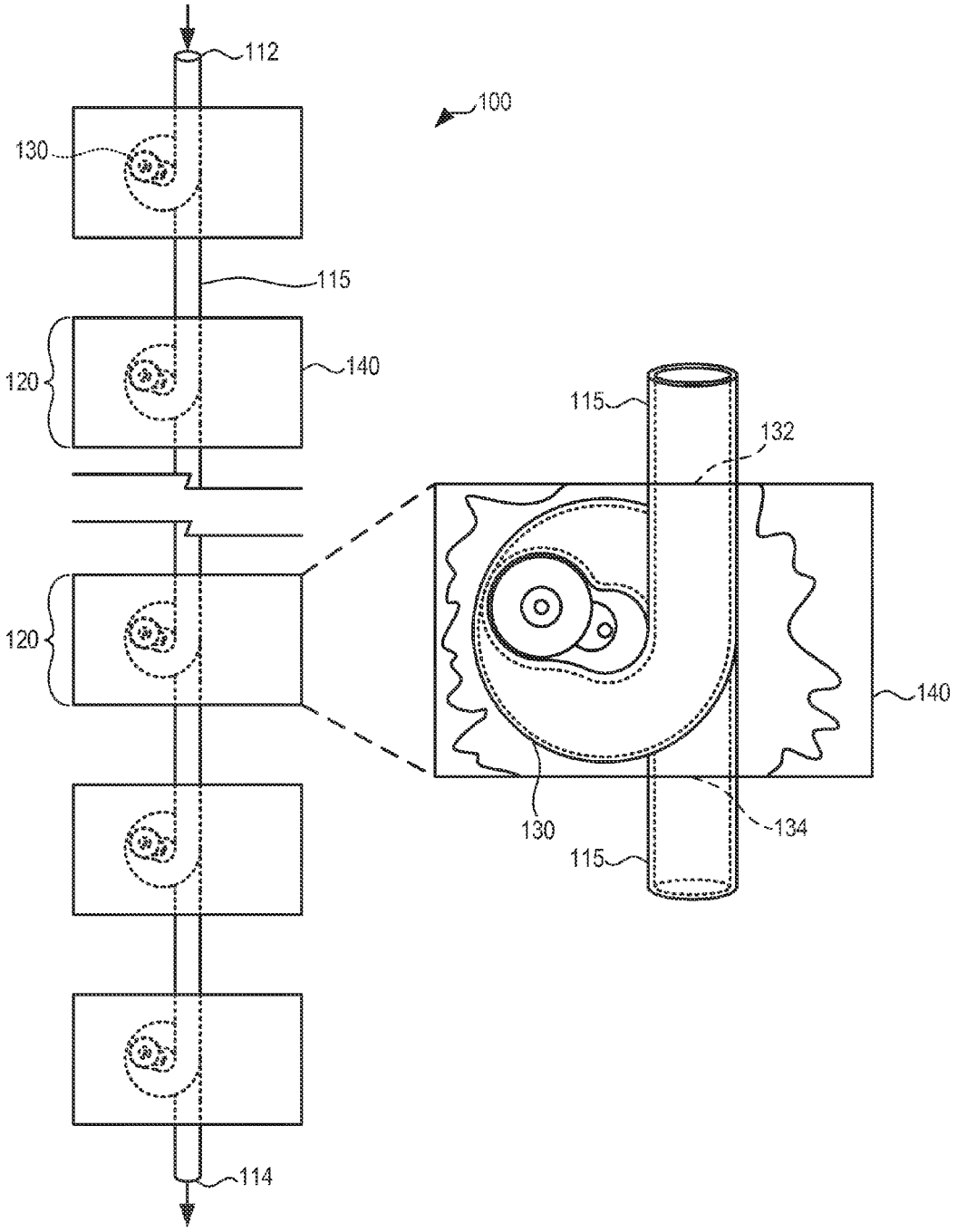
FIG. 1 is a schematic illustration of an embodiment of a peristaltic pump system comprising multiple stages.

Peristaltic pumps may be disposed serially to displace working fluid along a flow path comprised of multiple peristaltic pumps. Each pump may be configured to operate in connection with a particular pressure differential across the pump. Individual pumps of such systems may be configured to increase the working fluid pressure across the single pump by a much smaller magnitude than the pressure change across the entire system. Further, the space directly around a portion of the system may be sealed and pressurized such that the pressure exerted on the pump components within the sealed portion is comparable to the working fluid pressure across the portion.

As used herein, "pumps" generally refers to components or systems configured to displace or pressurize working fluid; a variety of inputs such as rotation, pressure, magnetic interaction, and so forth may power such pumps. Additionally, "motors" may refer to components configured to output kinetic energy in response to input energy of some type. In some embodiments, motors may be configured to output rotational displacement or other forms of kinetic energy based on pressure input. Thus, some systems may be run as a pump (displacing or pressurizing fluid in response to input energy) or as a motor (outputting energy in response to fluid displacement or pressure) or a combination thereof (combining fluid pressure/displacement input and output). Any of the components, systems, or devices described herein may be configured to operate as a pump or a motor, regardless of whether the disclosure refers to "pumps" or "motors" specifically. Thus, in some instances below, the term "pump" may be used for convenience; however, this term is intended to include similar systems which may be run as a motor rather than a pump, or as a combination thereof.

A peristaltic pump system may be configured with two or more working fluid flow paths for two or more working fluids. In some such embodiments, one working fluid may be initially pressurized and used to drive the system, with the system configured to pressurize the other working fluid. Such a system may be configured to recover pressure output from a separate process. Various exemplary embodiments of pump systems having one, two, or more fluid flow paths are further described below.

It will be readily understood that the components of the embodiments as generally described and illustrated in the Figures herein could be arranged and designed in a wide variety of different configurations. Thus, the following more detailed description of various embodiments, as represented in the Figures, is not intended to limit the scope of the disclosure, but is merely representative of various embodiments. While the various aspects of the embodiments are presented in drawings, the drawings are not necessarily drawn to scale unless specifically indicated.

The phrases "connected to," "coupled to," and "in communication with" refer to any form of interaction between two or more entities, including mechanical, electrical, magnetic, electromagnetic, fluid, and thermal interaction. Two components may be coupled to each other even though they are not in direct contact with each other. For example, two components may be coupled to each other through an intermediate component.

FIG. 1 is a schematic illustration of an embodiment of a peristaltic pump system 100 comprising multiple stages 120. All the figures herein are schematic in nature. In other words, the figures show the functional and operational relationships of components of the system, but are not intended to indicate any particular structure or spatial disposition of any component or any group of components in the system.

In the embodiment of FIG. 1, the peristaltic pump system 100 may comprise a system inlet 112 and a system outlet 114. A working fluid flow path may traverse the system 100 from the system inlet 112 to the system outlet 114. In other words, working fluid may enter the system 100 at the system inlet 112 and leave the system 100 at the system outlet 114.

Two or more peristaltic pump stages 120 may be disposed serially along the working fluid flow path. As indicated by the lines crossing the schematic illustration, any number of stages 120 may be included in the system 100. Each stage 120 may comprise a peristaltic pump 130 configured to displace working fluid along the working fluid flow path. Specifically, as shown in the inset detailed view, each peristaltic pump 130 may comprise a pump inlet 132 and a pump outlet 134.

Stages 120 of the peristaltic pump system 100 may be disposed such that the pump inlet 132 of a particular stage is in fluid communication with the pump outlet 134 of an adjacent stage, and the pump outlet 134 of a particular stage is in fluid communication with the pump inlet 132 of an adjacent stage. Thus, the stages 120 of the peristaltic pump system 100, taken together, may comprise a working fluid flow path extending from the system inlet 112 to the system outlet 114.

In the embodiment of FIG. 1, working fluid connection segments 115 are disposed between adjacent stages 120. In the illustrated embodiment these working fluid connection segments 115 bridge the spatial gap between adjacent peristaltic pumps 130 and complete the working fluid flow path. In other embodiments, adjacent stages 120 may be disposed directly adjacent, such that no working fluid connection segment 115 is used.

In some embodiments the system 100 of FIG. 1 may be operated by inputting rotational displacement to the peristaltic pumps 130 to displace working fluid along the working fluid flow path from the system inlet 112 to the system outlet 114. Operation of the peristaltic pumps 130 may create a working fluid pressure differential across each stage 120 of the system 100. For example, when the pumps 130 are in operation, the working fluid pressure at a pump inlet 132 may be lower (corresponding to a "low side" pressure of the pump) than the working fluid pressure at the pump outlet 134 (corresponding to a "high side" pressure of the pump) of the same stage.

In some embodiments the system 100 may be configured such that the pressure differential across any single stage 120 or pump 130 is substantially the same as the working fluid pressure differential across any other stage 120 or pump 130 of the system 100. Thus, the pressure differential across any single pump 130 may be substantially the same as the total pressure differential between the system inlet 112 and the system outlet 114 divided by N, where N represents the number of stages 120 of the system 100. In other embodiments the system 100 may be configured with other arrangements of pressure differentials across stages 120, such as pressure differentials across stages where the pressure differential is relatively higher or lower across stages disposed after (downstream from) or before (upstream from) a comparable stage along the working fluid flow path.

Thus, in some embodiments, the system 100 may be configured such that the pressure generated by any single pump 130 is smaller than the total pressure generated by the system 100. Decreasing the pressure generated by each pump 130 may allow the use of smaller or cheaper pumps within the system 100, as each pump 130 only generates a small amount of pressure as compared to the system 100.

In some embodiments, including embodiments wherein the pressure differential is substantially the same across each peristaltic pump 130 of the system 100, the system 100 may further be configured such that the work done by any single pump 130 of the system 100 is substantially the same as the work done by any other pump 130 of the system 100 over the same time interval. Similarly, the system 100 may be configured such that the power consumption by any single pump 130 is substantially equal to the power consumption by any other pump of the system 100 over the same time interval.

The embodiment of FIG. 1 further comprises pressure chambers 140 around each pump 130 of the system 100. The pressure chambers 140 may be configured to seal the pumps 130 disposed therein from fluid communication with an external environment. Though each pump 130 may thus be sealed from the external environment, as shown in FIG. 1, the working fluid flow path may be configured to cross the wall or boundary of the pressure chambers 140. The term "sealed," as used herein in connection with sealing a pump from fluid communication with an outside environment, is not intended to indicate that working fluid cannot cross the boundary of the seal. In this sense, a chamber, barrier, envelope, or other component may seal additional components, such as a pump, by enclosing the pump and maintaining a pressure around the pump which differs from the pressure of an environment external to the enclosure. In some embodiments, each pump 130 of the system 100 may be disposed in a single pressure chamber 140, while in other embodiments only certain pumps 130 may be disposed within pressure chambers 140. Further, in some embodiments one or more pressure chambers 140 may be configured to seal more than one pump 130.

In some embodiments, the fluid pressure of the external environment may be much higher or much lower than the absolute working fluid pressure at certain points along the fluid flow path. Thus, pressure chambers 140, working fluid connection segments 115, and/or other components may be configured to maintain pressure (at a pressure other than the environmental pressure) around other components of the system 100 or on the working fluid within the system 100.

The pressure chambers 140 may comprise a sealed vessel acting to maintain pressure on the pumps 130 disposed within the pressure chambers 140. The pressure chambers may be rigid, such as a hard-walled pressure vessel, or flexible, such as a flexible sided balloon. A flexible walled pressure chamber may be utilized to maintain pressure as pressure within the pressure chamber 140 may be greater than pressure outside. In the illustrated embodiment, a single pump 130 will be acted upon only by any fluid pressure within the pressure chamber 140, regardless of the pressure or any pressure fluctuations in the external environment.

In the illustrated embodiment, each pump 130 of the system 100 is disposed in a pressure chamber 140 and each pressure chamber 140 contains only one pump 130. The working fluid connection segments 115 extend between adjacent pressure chambers 140. In some embodiments, the working fluid connection segments 115 may be rigid; for example, the working fluid connection segments 115 may comprise a steel pipe. In other embodiments the working fluid connection segments 115 may not be rigid, while being configured to support the difference in pressure between the interior of the working fluid connection segments 115 and the outside pressure. In some instances, the working fluid connection segments 115 may be configured to prevent outside environmental pressure from acting on the working fluid flow path at the working fluid connection segments 115.

Thus, in the illustrated embodiment, the working fluid flow path between the system inlet 112 and the system outlet 114 may be sealed from fluid interaction with the external environment. The body of each pump 130 will only be subjected to any fluid pressure within its associated pressure chamber 140. Working fluid at a pump inlet 132 will only interact with the working fluid pressure at the pump outlet 134 that feeds the particular pump inlet 132 and working fluid pressures induced by the pump 130 itself. Likewise, working fluid pressure at a pump outlet 134 will only interact with the working fluid pressure of an adjacent pump inlet 132 and working fluid pressures induced by the pump 130 itself. In the illustrated embodiment, the system 100 is therefore sealed such that the pressure of the external environment does not directly impact the operation of the system 100.

The pressure chambers 140 and the working fluid connection segments 115 may be configured for use across greater pressure differentials than the pressure differentials across any individual pump 130. Again, the fluid pressure of the external environment may be much higher or much lower than the absolute working fluid pressure at certain points along the working fluid flow path. The pressure chambers 140 and working fluid connection segments 115 may thus be configured to withstand the difference between the working fluid pressures and the external environment. In some such embodiments, the pressure chambers 140 may be pressurized with respect to the external environment.

In embodiments where the system 100 is configured with pressurized pressure chambers 140, the system 100 may be configured such that individual system components are only subject to small pressures as compared to the working fluid pressure differential across the entire system 100. Components of individual pumps 130, for example, may only be subjected to the pressure across the pump 130, even if the absolute pressure of working fluid within the pump 130 is high by comparison. Thus, some systems 100 within the scope of this disclosure may comprise pumps 130 and other elements only designed or rated for small pressure differentials, while the system 100 is configured to produce a large working fluid pressure differential. Components and systems for pressurizing the pressure chambers 140 or other portions of the system 100 are discussed in further detail below, including the disclosure recited in connection with FIG. 3.

FIGS. 2A-2D are schematic illustrations of another embodiment of a peristaltic pump system 200 in four different configurations. The embodiment of FIGS. 2A-2D may include components that resemble components of the embodiment of FIG. 1 in some respects. For example, the embodiment of FIG. 2A includes a schematic element designated as a stage 220 of the system 200 that may resemble the schematic representation of stage 120 of FIG. 1. It will be appreciated that all the illustrated embodiments have analogous features and components. Accordingly, like or analogous features are designated with like reference numerals, with the leading digits incremented to "2." Relevant disclosure set forth above regarding similarly identified features thus may not be repeated hereafter. Moreover, specific features of the system and related components shown in FIGS. 2A-2D may not be shown or identified by a reference numeral in the drawings or specifically discussed in the written description that follows. However, such features may clearly be the same, or substantially the same, as features depicted in other embodiments and/or described with respect to such embodiments. Accordingly, the relevant descriptions of such features apply equally to the features of the system and related components of FIGS. 2A-2D. Any suitable combination of the features, and variations of the same, described with respect to the system and components illustrated in FIG. 1 can be employed with the system and components of FIGS. 2A-2D, and vice versa. This pattern of disclosure applies equally to further embodiments depicted in subsequent figures and described hereafter.

It will be appreciated by one of skill in the art having the benefit of this disclosure that the system 200 of FIGS. 2A-2D may function in an analogous manner to the system 100 described in connection with FIG. 1. Thus, while specific features and elements of the system 200 will be described below, disclosure above regarding the relationship of components and the function of the system 100 of FIG. 1 may be applied to the system 200 of FIGS. 2A-2D. Again, this pattern of disclosure applies to subsequent disclosure as well: disclosure relative to any embodiment may be analogously applied to any other embodiment herein.

Figure 2A:
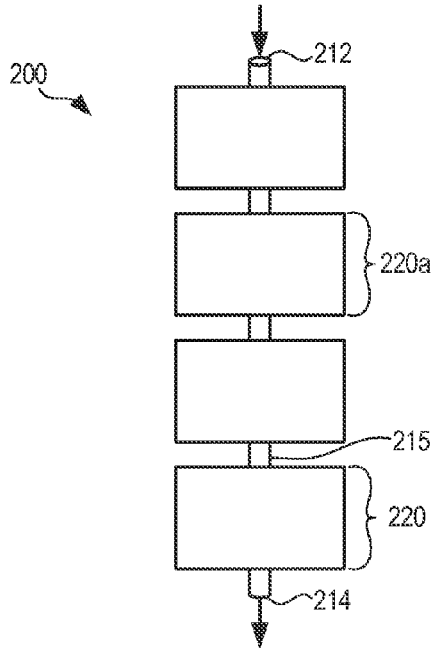
FIG. 2A is a schematic illustration of another embodiment of a peristaltic pump system in a first configuration.

FIG. 2A is a schematic illustration of the peristaltic pump system 200 in a first configuration. The system 200 comprises a system inlet 212 and a system outlet 214 as well as serially arranged pump stages 220 along a working fluid flow path from the system inlet 212 to the system outlet 214. Working fluid connection segments 215 are disposed between adjacent stages 220.

In some embodiments the system 200 may be configured such that one or more stages 220 may be removed from the system 200. For example, in the case of failure or other maintenance of a single pump stage 220, the system 200 may be configured such that the affected stage 220 may be removed without disassembling the entire system 200.

Figure 2B:
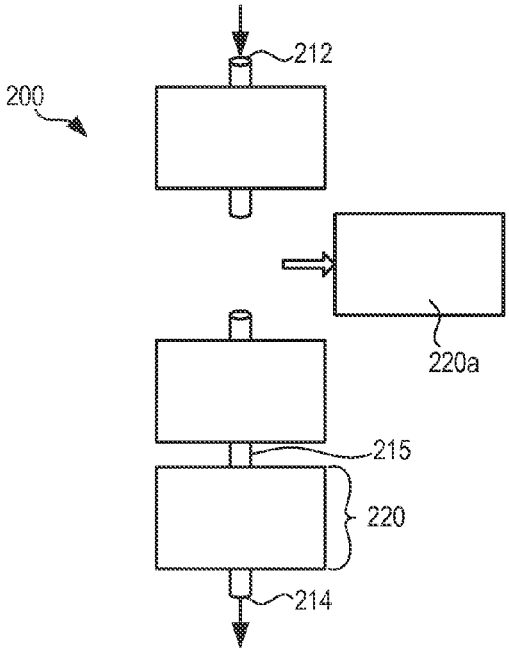
FIG. 2B is a schematic illustration of the peristaltic pump system of FIG. 2A in a second configuration.
Figure 2C:
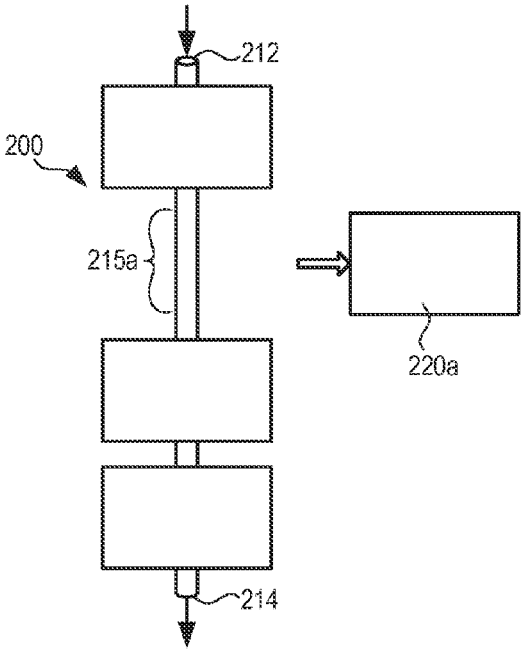
FIG. 2C is a schematic illustration of the peristaltic pump system of FIG. 2A in a third configuration.
Figure 2D:
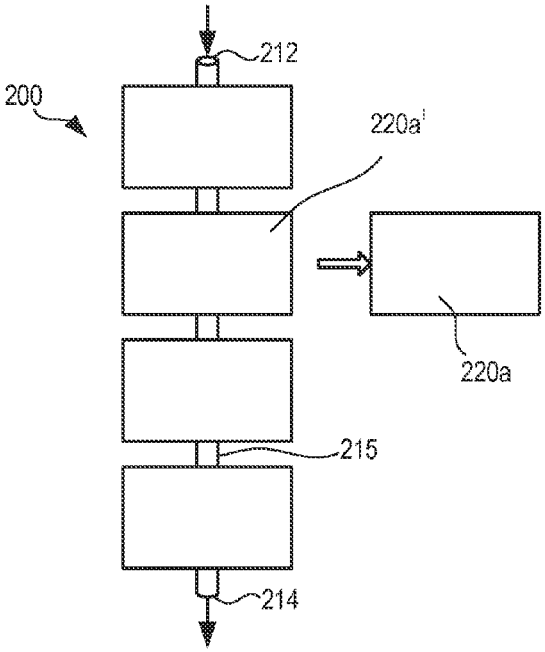
FIG. 2D is a schematic illustration of the peristaltic pump system of FIG. 2A in a fourth configuration.

One particular stage of FIG. 2A is designated by the reference numeral 220*a*. The system 200 may be configured such that stage 220*a* or any other stage 220 may be easily removed from the system 200. In the configuration of FIG. 2A, stage 220*a* is disposed along the working fluid flow path. FIGS. 2B-2D illustrate the system 200 in various alternative configurations. The system inlet 212, system outlet 214, pump stages 220, and working fluid connection segments 215 are illustrated in each of these figures.

In the configuration of FIG. 2B, stage 220*a* is shown physically removed from the working fluid flow path. FIG. 2C illustrates a configuration wherein an extended working fluid connection segment 215*a* is disposed within the working fluid flow path in place of stage 220*a*. Thus, in the configuration of FIG. 2C, stage 220*a* has been bypassed from the system 200. In other configurations, a stage 220 may be bypassed without physically removing the stage 220 from the system 200, for example, by simply running an extended working fluid connection segment around the stage to be bypassed. Various additional conduits, valves, or couplings may be configured to redirect the working fluid if a stage 220 is bypassed.

The system 200 may be configured such that if one or more stages 220 are bypassed, the working fluid pressure change along the entire flow path is decreased by the pressure differential originally across the now removed stage 220. In other embodiments the system 200 may be configured such that the total working fluid pressure change across the system 200 remains constant, including embodiments where additional pressure to compensate for any bypassed segments is generated in equal shares by the remaining stages 220.

The system 200 may further be configured such that one or more stages 220 may be easily and quickly removed, including embodiments wherein stages 220 may be removed without the use of tools. For example, quick connect-type fittings or connections may be used to couple adjacent stages 220. In some embodiments, removing a stage 220 comprises removing a pump (130 of FIG. 1) and pressure chamber (140 of FIG. 1) associated with that stage. Further, the system 200 may be configured such that removal of a stage 220 does not require the system 200 to be shut down. For example, working fluid flow may be locally suspended while a stage 220 is quickly bypassed without shutting down flow through the system 200 completely.

FIG. 2D is a schematic illustration of the peristaltic pump system 200 in a fourth configuration, with stage 220*a* removed and an alternative stage 220*a*' disposed in its place. Alternative stages 220*a*' may be configured to be installed by the same methods used to remove stages 220, including methods that do not require tools.

Figure 2E:
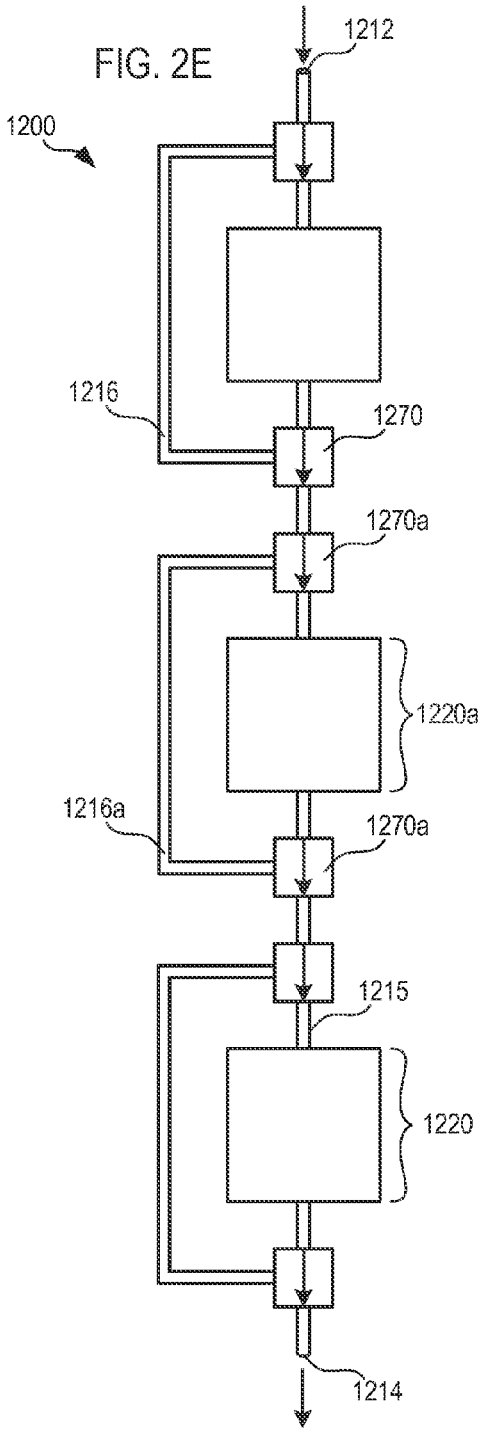
FIG. 2E is a schematic illustration of another embodiment of a peristaltic pump system in a first configuration.
Figure 2F:
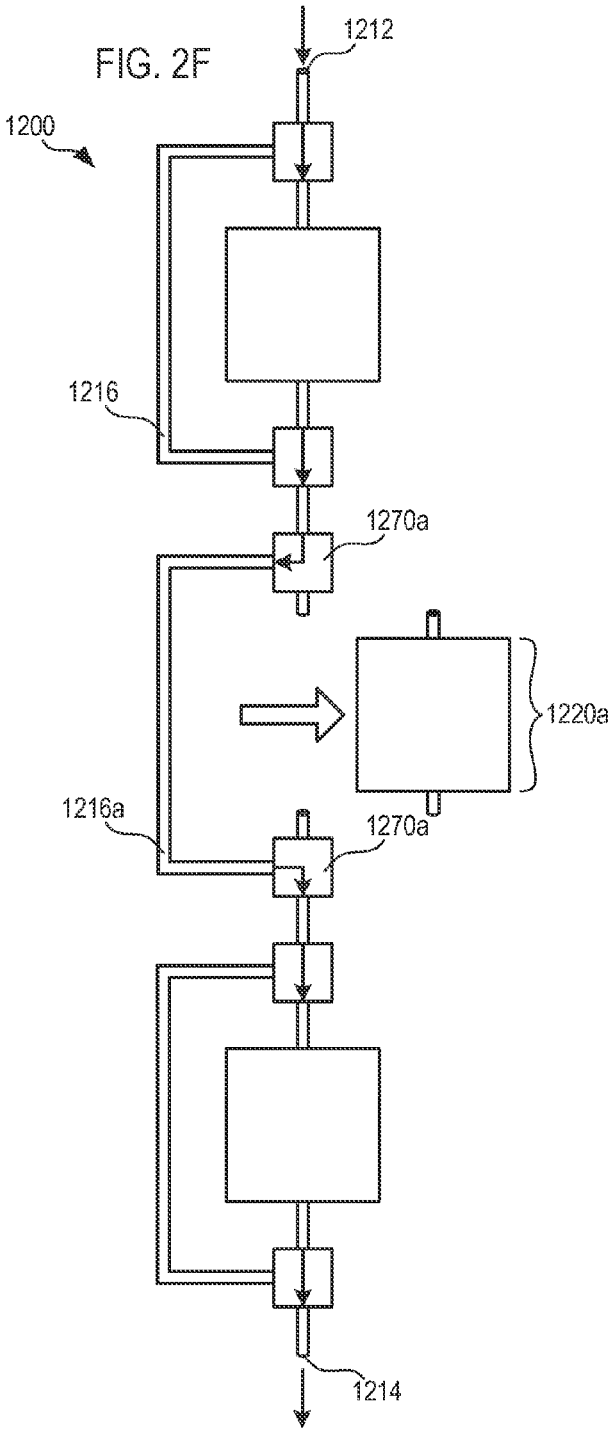
FIG. 2F is a schematic illustration of the peristaltic pump system of FIG. 2E in a second configuration.

FIGS. 2E and 2F are schematic illustrations of another embodiment of a peristaltic pump system 1200, in a first and second configuration, respectively. Disclosure given in connection with the embodiment of FIGS. 2A-2D may be analogously applied to the embodiment of FIGS. 2E-2F. In the latter embodiment, references numerals have been altered by added a leading "1" to each numeral in order to show relationships between analogous components. In the embodiment of FIGS. 2E-2F, working fluid may proceed through the system 1200 from a system inlet 1212 to a system outlet 1214 through a plurality of stages 1220. Working fluid connections 1215 may couple adjacent stages 1220. Further, as compared to the embodiment of FIGS. 2A-2D, each stage 1220 may comprise a stage bypass line 1216. Valves 1270 may be positioned to allow an operator to quickly divert working fluid flow around a stage 1220 through a bypass line 1216.

Bypass lines 1216 may be used to remove a stage 1220, for example for repair. For example, stage 1220*a* has been removed in the configuration of FIG. 2F as compared to the configuration of FIG. 2E. As the arrows associated with the valves 1270*a* for stage 1220*a* indicate, flow in the configuration of FIG. 2E is directed through stage 1220*a*, while flow in the configuration of FIG. 2F is directed through bypass line 1216*a*.

System 1200 may be configured to facilitate bypassing a single stage quickly, without shutting the system 1200 down. The system 1200 may be configured to automatically adjust such that the remaining stages 1220 take a slightly greater pressure differential (keeping the pressure change across the system constant) when stage is removed.

Figure 3:
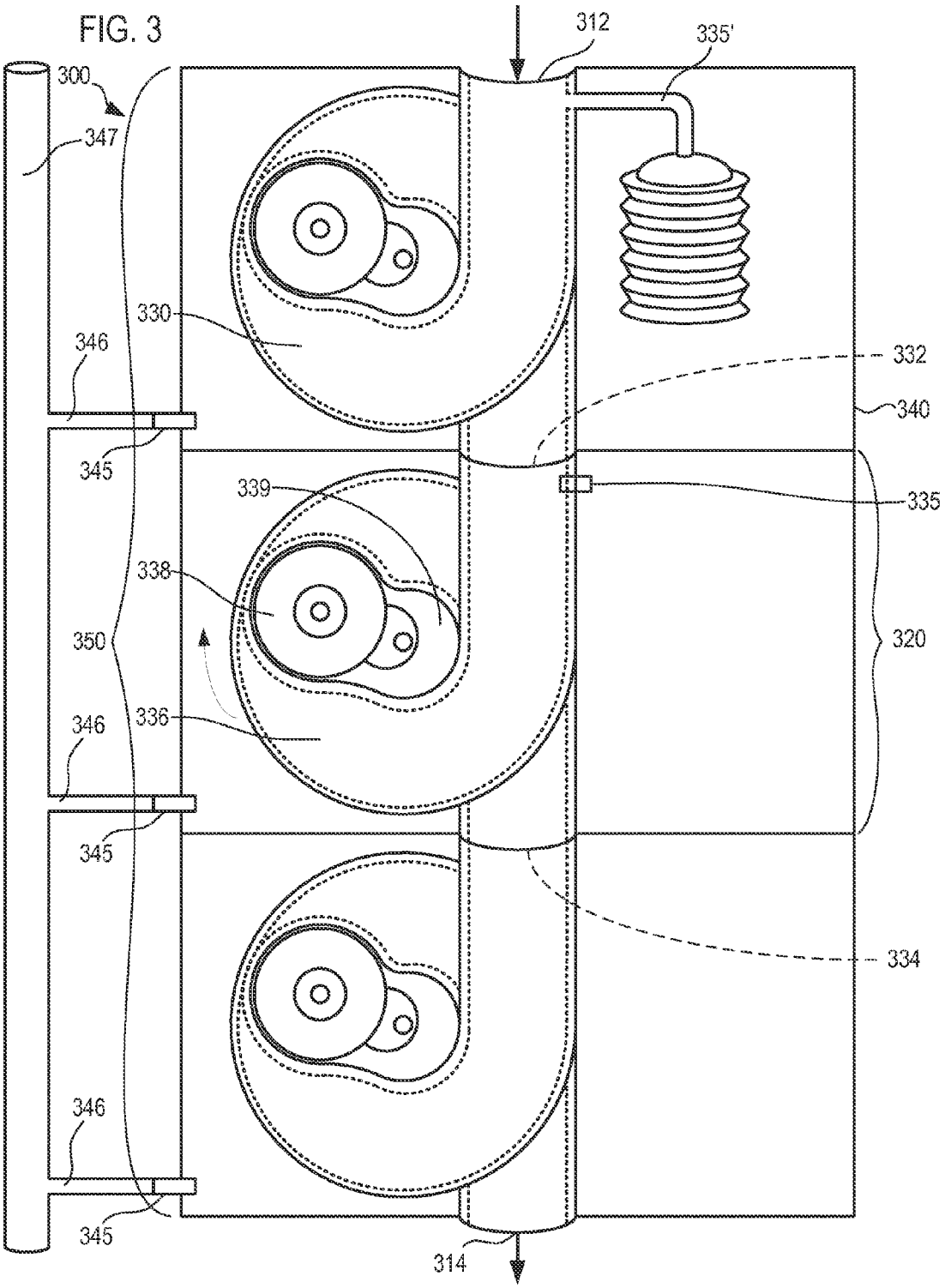
FIG. 3 is a schematic illustration of another embodiment of a staged peristaltic pump system.

FIG. 3 is a schematic illustration of another embodiment of a staged peristaltic pump system 300. In the embodiment of FIG. 3, the system 300 comprises three stages 320, each comprising a peristaltic pump 330 and a pressure chamber 340. In the illustrated embodiment, a top portion of each pressure chamber 340 has been removed to expose the pumps 330. The stages 320 are disposed such that adjacent pressure chambers 340 are disposed directly adjacent each other. The pressure chambers 340 may be disposed such that one or more walls of each pressure chamber 340 directly abut one or more walls of adjacent pressure chambers 340. In some embodiments the system 300 may be configured such that adjacent pressure chambers 340 share a single wall.

The system 300 may be configured such that the pumps 330 and other components are not in direct fluid communication with an external environment. Further, the system 300 may be configured such that the pressure chambers 340 are pressurized with respect to the external environment. Pressurization of pressure chambers 340 is meant to include both instances where the absolute pressure within a pressure chamber 340 exceeds the pressure of the external environment and instances where the absolute pressure within a pressure chamber 340 is lower than that of the external environment. Portions of the pressure chambers 340 (such as walls of the pressure chambers 340 adjacent to other pressure chambers 340) may only be configured to withstand the pressure difference between adjacent chambers 340, while other portions of the pressure chambers 340 (such as walls adjacent the external environment) may be configured to withstand greater pressure differentials.

The system 300 may comprise one or more systems or elements configured to regulate pressure within the pressure chambers 340. Such systems may be configured both to pressurize and to depressurize the pressure chambers 340. For example, the system 300 may comprise one or more pressurization valves 345, including embodiments wherein each pressure chamber 340 comprises a pressurization valve 345. The valves 345 may be configured to allow introduction of a fluid such as a gas or liquid from an outside source into the interior of the pressure chamber 340 to pressurize the pressure chamber 340. Similarly, the valve 345 may be configured to allow equalization of pressure within the pressure chamber 340 and the external environment (in other words, depressurization of the pressure chamber 340). In some embodiments the pressurization valve 345 may be used in connection with a system of sensors and/or compressors designed to control pressure within the pressure chamber 340. The pressure chamber 340 may be pressurized with a gas, a liquid, or a combination thereof.

In the illustrated embodiment, the valves 345 are coupled to supply conduits 346 extending between a high pressure source 347 and the valves 345. The high pressure source 347 may be configured to supply pressure, and each valve 345 may be configured to control the amount of pressure acting on the associated pressure chamber 340.

In some embodiments, each pressurization chamber 340 may be pressurized to substantially the same pressure as the low-side working fluid pressure of the associated pump 330. In such embodiments, working fluid at the pump inlet 332 will be at substantially the same pressure as the interior of the pressure chamber 340. The only pressure differential acting on the pump 330 will be the difference between this pressure and the working fluid pressure at the pump outlet 334. The low-side working fluid pressure of the next adjacent downstream stage 320 may thus be equal or substantially equal to the high-side working fluid pressure of the adjacent upstream stage 320. Thus, the pressure differential between adjacent pressure chambers 340 may be substantially the same as the pressure differential across a single pump 330.

In some embodiments, pressure within the pressure chamber 340 may be partially or wholly supplied by the working fluid. For example, in some instances a regulator 335 may be coupled to the working fluid flow path at the low side of the pump 330. The regulator 335 may comprise a valve in some embodiments. The regulator 335 may also comprise any system or device configured to control pressure exchange between the pressure chamber 340 and the working fluid. Such systems may be used in place of, or in connection with, other pressure control systems such as the high pressure source 347.

In some instances the regulator 335 may be directly coupled to the low-side working fluid. In some instances, the regulator 335 may comprise a vent between the low-side working fluid and the pressure chamber 340, allowing the pressure chamber 340 to be at least partially filled with working fluid at the same pressure as the low side of the associated pump 330. In some embodiments the pressure chamber 340 and pump 330 may be configured such that the pressure within the pressure chamber is configured to cooperate with the pump 330 such that the pump 330 maintains a substantially constant enclosed volume during operation (in other words, such that portions of the pump 330 containing working fluid do not significantly expand or contract to change the total enclosed volume of the pump 330).

Thus, in various embodiments, pressure within each pressure chamber 340 may be related to the pressure of the working fluid at one side of the associated pump 330. In some embodiments the pressure difference between adjacent pressure chambers may be between zero and four times the pressure drop across a pump, including about two times or less.

Further, one or more pressure chambers 340 may be vented to the external environment. For example, a peristaltic pump 330 disposed at one end of a series of pumps may have an outlet or inlet that is in fluid communication with the external environment (the system outlet 314 or inlet 312 in some embodiments). The pressure chamber associated with such a pump may be vented such that it is in fluid communication with the external environment in some embodiments.

The regulator 335 may also be used in connection with a mechanical coupling to pressurize fluid within the pressure chamber 340. For example, a diaphragm regulator disposed between the low-side working fluid and the pressure chamber 340 may be configured to equalize pressure on either side of the regulator, including embodiments wherein the fluids on either side of the regulator differ. In such embodiments, the regulator 335 may comprise a valve and a diaphragm regulator. In other embodiments the regulator 335 may comprise a valve disposed to indirectly couple the low-side working fluid with the pressure chamber 340, including, for example, through interaction with an intermediate fluid. In such embodiments, multiple diaphragm regulators may be utilized to couple the fluids.

Furthermore, in some embodiments a bellows, such as bellows 335', may also be used in place of any diaphragm regulator in connection with any of the regulators discussed above. Additionally, the bellows 335' may comprise a valve configured to supply pressure from the working fluid to the pressure chamber through a controlled passage or controlled leak of fluid across the valve. In some such embodiments, the pressure chamber may be at least partially filled with working fluid.

The regulator 335 may alternatively or additionally comprise an electronic system comprising a sensor and a control system, configured to regulate pressure within the pressure chamber 340. Any of the components, sources, regulators, or valves may also be manually set, for example by mechanically adjusting a setting on the component.

In some embodiments, the system 300 may further comprise one or more pressure envelopes configured to seal one or more pressure chambers 340 from fluid communication with the external environment. The pressure envelopes may share a common wall or other components with the pressure chambers 340. For example, in the embodiment of FIG. 3, the walls between each pressure chamber 340 and the external environment may be termed the pressure envelope while the walls between adjacent pressure chambers may be termed dividers. The walls comprising the pressure envelope may be configured to withstand the full pressure differential between the pressure chambers 340 and the external environment while the dividers may only be configured to withstand the pressure differential between adjacent pressure chambers 340.

A pressure envelope which seals the entire system 300 from fluid communication with the external environment (while allowing working fluid flow across the envelope adjacent the system inlet 312 and system outlet 314) may be termed a pressure barrier 350. In embodiments comprising working fluid connection segments (115 of FIG. 1) the pressure barrier 350 may be comprised of portions of the pressure chambers 340 and portions of the working fluid connection segments.

In the embodiment of FIG. 3, the pressure barrier 350 is illustrated as a rectangular exterior wall of the system 300. As the Figures are schematic in nature, any functional spatial arrangement of the system 300 is within the scope of this disclosure. For example, in the illustrated embodiment the working fluid flow path may be understood as generally linear along the length of the system 300, while looping around each pump 330 of the system 300. In another embodiment, the working fluid flow path may be generally linear (without the looping portions); in such embodiments the peristaltic pumps 330 may comprise additional rollers or components as described further below. In other embodiments, the working fluid flow path may be generally helical with the rotational axis of the pumps 330 generally disposed along a central axis of the helix. In some such embodiments, the working fluid flow path may comprise helical portions coupled by connection portions which may not be generally helical. Further, in some embodiments, the pressure barrier 350 may comprise a generally tubular structure, such as a metal pipe, and the working fluid flow path may be generally disposed, helically or otherwise, along the inside diameter of the pipe.

Peristaltic pumps 330 may comprise flexible portions 336 which are compressed by rollers or shoes 338 mounted to a rotor 339. The shoes 338 may be configured to progressively compress the flexible portion 336, forcing working fluid along the flow path. In some embodiments, a single rotor 339 may be coupled to multiple rollers or shoes (for example the embodiment shown in FIG. 5). Continuous rotation of the rotors may create substantially continuous flow within the working fluid flow path.

Flexible portions 336 configured to withstand large pressure differentials may necessarily be stiff and therefore difficult to compress, introducing energy loss into the system 300 due to the energy required to compress the flexible portion. Use of pressure chambers 340 and pressure barriers 350 may thus facilitate use of peristaltic pumps with highly flexible flow path tubes with large pressures while maintaining a more efficient system. Additionally, systems incorporating pressure chambers 340 may enable certain components of the systems (such as pumps 330, pump seals, pump flexible portions 336, and so forth) which are configured for use in connection with pressure differentials much smaller than the pressure differential between the system inlet 312 and the system outlet 314. The system 300 may thus be comprised of less expensive components while increasing efficiency.

The flexible portion 336 of the pump 330 may comprise a flexible tubular member, such as an elastomeric tube. In some instances the elastomeric tube may be reinforced, for example by a metal scaffold or mesh or a non-metallic scaffold or mesh. The flexible portion 336 may alternatively comprise a flexible metal tube. In some instances the flexible portion 336 may be constructed for use in connection with viscous, abrasive, chemically reactive, corrosive, or high-temperature working fluids. The flexible portion 336 may also be sized to facilitate relatively high volume flow at relatively low velocities.

The flexible portion 336 may alternatively comprise two flexible ribbons, curved apart from each other (similar to opposing parenthetical marks) and sealed at the longitudinal sides. The ribbons may be flattened and compressed by the rollers 338 of the peristaltic pump 330, or compressed by shoes of the peristaltic pump 330 in some embodiments. Further, in some embodiments the ribbons may be comprised of metal and may or may not be coated with a material to prevent corrosion or cracking of the ribbons and/or to increase sealing between the ribbons. For example the ribbons may comprise a metal coated on the inside surface with polytetrafluoroethylene or other non-metallic material.

The edges of the ribbons may be coupled by gluing, welding, or other methods. Further, use of metal or other high-temperature materials for the ribbons may allow use of the system 300 in connection with high-temperature working fluids.

The system 300 may further comprise a drive system configured to rotate one or more of the rotors 339 of the system 300. As also described above, the system 300 may be configured such that rotational displacement input into the system 300 may induce working fluid flow and/or increase working fluid pressure across the system 300.

In some embodiments, the drive system may comprise a plurality of independent motors, each motor coupled to a single pump 330 of the system 300. In other embodiments, a single motor may be coupled to each of the rotors 339 of the system 300. For example, each rotor 339 may be coupled to a drive shaft which is then coupled to a belt or chain drive operably coupled to the motor. A belt or chain drive may be configured to drive each of the drive shafts at the same rotational speed.

In embodiments, such as that of FIG. 3, which comprise a pressure barrier 350 or pressure chambers 340, the drive system may be configured to operably cross the pressure barrier 350 and or pressure chambers 340. For example, each rotor 339 may be coupled to a drive shaft, and the drive shafts may cross the pressure barrier 350 and/or pressure chamber 340 walls. Seals may be disposed around the drive shafts at the pressure barrier 350 or pressure chamber 340 walls to maintain the integrity of the pressure boundary.

In other embodiments the drive system may not mechanically cross the pressure barrier 350 or pressure chamber 340 walls. For example, the drive system (such as individual motors) may be disposed within the pressure barrier 350 or pressure chambers 340. The drive system may also be disposed outside of the pressure barrier 350 or pressure chambers 340 but not mechanically cross the pressure boundary. For example, the peristaltic pumps may be driven via non-contact magnetic drive couplings.

Additionally, the system 300 may be configured such that the rotational displacement input into the system 300 is driven by some other process. In some such instances the other process may be at least partially driven by pressure, including instances where that driving pressure is an output of the system 300.

The system 300 may also be configured such that any combination of pressure (at the system inlet 312) input and rotational displacement input is configured to drive the system 300. The system 300 may be configured to automatically adjust to changes in input pressure or rotation to maintain a constant output pressure or energy use. A combination of inputs may be configured to initially prime the system 300.

In some embodiments, the system 300 may be configured to automatically equalize the working fluid pressure change across each peristaltic pump 330. This equalization may be actively or passively controlled. For example, the system 300 may be configured to allow a small amount of working fluid leakage across the pumps 330 (for example, by allowing fluid to push past the rollers or shoes 338) such that pressure tends to equalize across each pump 330. The system 300 may also be provided with a bypass line to allow fluid to leak around each pump 330. Such bypass lines may comprise regulators or valves and may or may not be actively controlled, such as by a computer. Additionally, systems 300 wherein the pumps 330 are driven by a common shaft or other drive mechanism may tend to equalize the pressure across each pump 330. A slip clutch may be used to vary rotational speed to equalize pressure for each rotor coupled to a common shaft. In some embodiments each pump 330 may be coupled to and driven by a separate electric motor. Supplying appropriate drive power to each motor may equalize pressure change across each pump 330 of the system 300. Still further, valves, connections, electronic controls, and so forth may be used to control pressure across each pump 330.

The equalization of pressure across various pumps 330 of the system 300 may be achieved when the system 300 is in steady-state operation. In some embodiments, during startup, shutdown, or changes in operation parameters, the system 300 may be configured to run for a time to equalize pressure and reach steady-state operation.

Methods are also contemplated in connection with the systems and elements disclosed above. Disclosure recited in connection with any system herein may be analogously applied to any method. An exemplary method relating to the systems discussed above may comprise a method of increasing the pressure of a working fluid in a staged peristaltic pump system comprising displacing working fluid in stages along a flow path from a system inlet to a system outlet wherein the working fluid pressure change across any single pump is substantially the same as the working fluid pressure change across any other pump in the plurality of peristaltic pumps.

Figure 4:
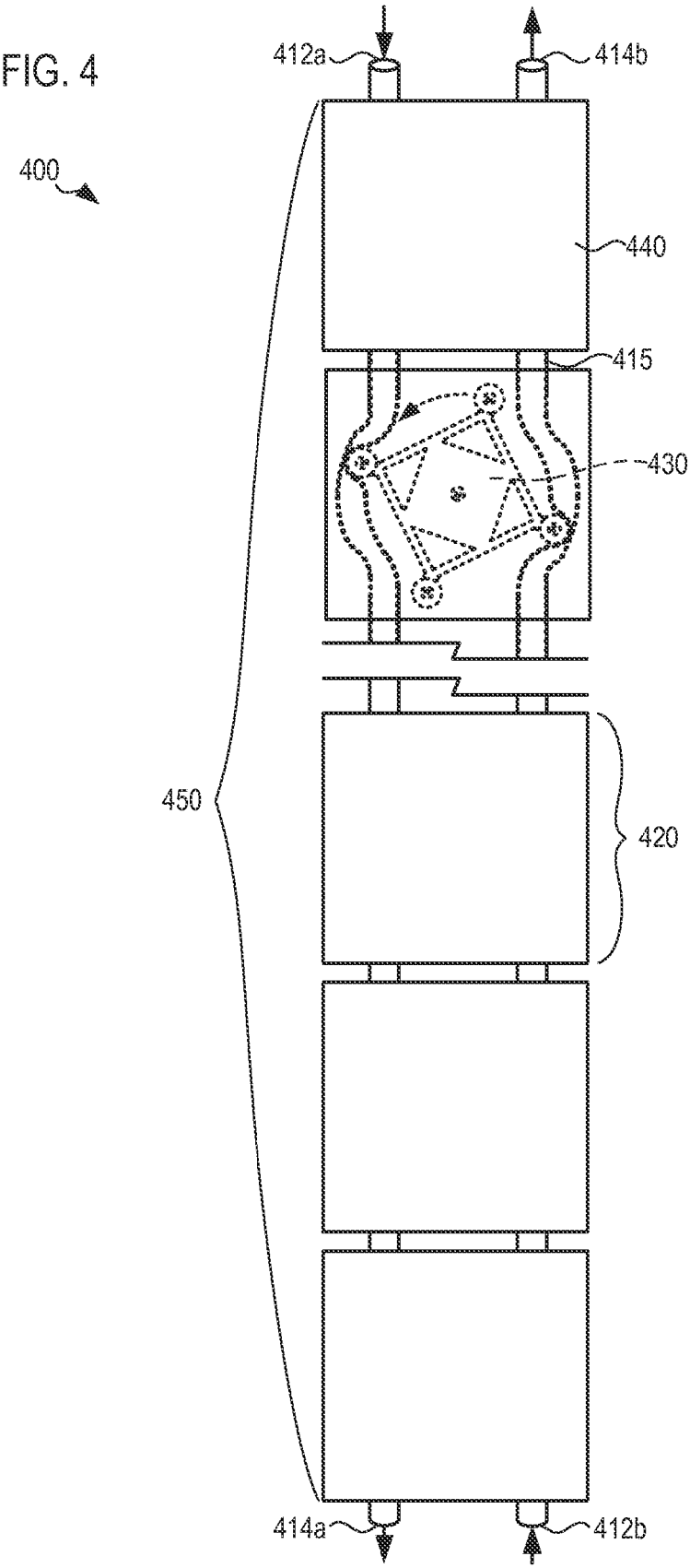
FIG. 4 is a schematic illustration of an embodiment of a peristaltic pump system comprising multiple stages and two working fluid flow paths.
Figure 5:
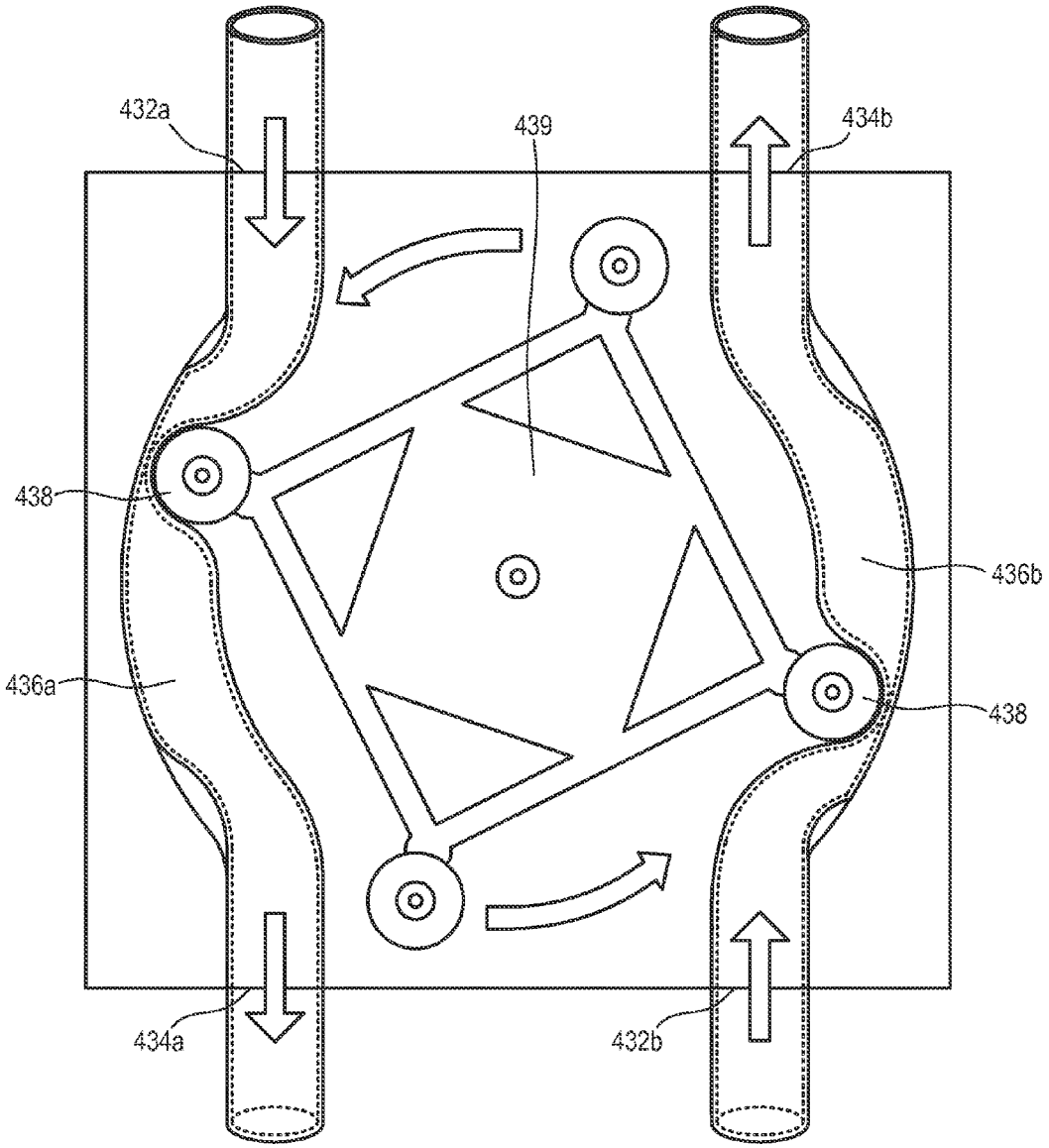
FIG. 5 is a schematic illustration of a single stage of the peristaltic pump system of FIG. 4.

FIGS. 4 and 5 are schematic illustrations of embodiments of a peristaltic pump system comprising two working fluid flow paths. The features, elements, systems, methods, and so forth described in connection with the single working fluid flow path systems of FIGS. 1-3 may be analogously applied to the embodiments of FIGS. 4-5. For example, disclosure relative to peristaltic pumps generally, fluid flow path patterns, pump construction, system inputs, pressurization, bypassing elements, and so forth, are all equally applicable to these embodiments. This list is intended to be illustrative, not exhaustive, of the analogous features of the systems.

In some embodiments, a system may comprise two working fluid flow paths each controlled by separate pumps. For example, a series of pumps may interact only with the first working fluid, and another series of pumps may interact only with the second working fluid. In some such embodiments, pumps of both series may be disposed in the same pressure chambers or pressure barrier. In some such embodiments, pumps within the same chamber may be coupled by a shaft. In some instances, one series of pumps may be driven by fluid pressure (motor-type operation), which may then drive the other series of pumps (through the coupling shafts). In other embodiments, a single pump rotor may interact with both working fluids, as further detailed below. Disclosure below relating to systems wherein two working fluid flow paths interact with common rotors, rollers, or shoes may be analogously applied to systems comprising separate pumps coupled by shafts or other mechanisms.

FIG. 4 is a schematic illustration of an embodiment of a peristaltic pump system 400 comprising multiple stages 420 and two working fluid flow paths. The first working fluid flow path extends between a first system inlet 412*a* and a first system outlet 414*a*, and the second working fluid flow path extends between a second system inlet 412*b* and a second system outlet 414*b*. A plurality of peristaltic pump stages 420 are disposed serially along the first and second fluid flow paths. The system 400 may be configured such that each peristaltic pump 430 interacts with both the first and second working fluid flow paths. In some embodiments the system 400 may be configured such that the first working fluid pressure change across any single peristaltic pump 430 is substantially the same as the first working fluid pressure change across any other peristaltic pump 430 of the system 400. In some such embodiments, the pressure change in the first working fluid across a pump may be within about 15 psi, within about 10 psi, or within about 5 psi of the pressure change of the second working fluid across the same pump. Additionally, the system 400 may be configured such that the second working fluid pressure change across any single peristaltic pump 430 is substantially the same as the second working fluid pressure change across any other peristaltic pump 430 of the system 400. Still further, in some embodiments, the first working fluid pressure differential or change across a single peristaltic pump 430 is substantially the same as the second working fluid pressure differential or change across the same peristaltic pump 430 or any other peristaltic pump 430.

A two-sided peristaltic pump system, such as system 400, may be configured to recover pressure output from a separate process. For example, the system 400 may be configured such that pressure input at the first system inlet 412*a* is configured to turn the peristaltic pumps 430 such that the peristaltic pumps 430 induce flow along the second working fluid flow path. As further discussed below, the system 400 may also be configured to operate based on rotational displacement input, or based on a combination of pressure input and rotational displacement input. In some such embodiments, the power associated with the rotational displacement input may be small as compared to the power associated with the pressure input, including embodiments wherein the rotational displacement input is configured to compensate for frictional or other losses in the system 400.

The system 400 may also be configured such that the power consumed by any single stage 420 or pump 430 of the system 400 is substantially the same as the power consumed by any other stage 420 or pump 430 over the same time interval. Additionally, the system 400 may be configured such that the work done by any single stage 420 or pump 430 is substantially the same as the work done by any other stage 420 or pump 430 over the same time interval. The system 400 may be configured such that the work done by any stage 420 or pump 430 remains substantially the same as the work done by any other stage 420 or pump 430 even when the input pressure or input rotational displacement changes during the time interval. In some embodiments the system 400 may be configured to automatically adjust to changes in the inputs, or to automatically compensate for changes in one type of input by adjusting the second input.

The system 400 may be configured such that the work done on or work done by one working fluid at a single pump is the same as the work done on or work done by the other working fluid at the same pump. In other words, in some instances the change in pressure times the flow rate of the first working fluid across a pump may be the same as the change in pressure times the second working fluid flow rate across the same pump. The first and second working fluids may or may not comprise the same fluid and may have different pressure changes or flow rates while still representing the same amount of work. In other words, the product of the change in pressure times the flow rate for the first working fluid may be the same magnitude, with opposite sign, as the pressure times the flow rate for the second working fluid across the same pump. This may be the case whether the pressures across each side are the same or different, the flow rates across each side are the same or different, and/or the cross sections of the flow path associated with each side are the same or different.

FIG. 5 is a schematic illustration of a single stage 420 of the peristaltic pump system 400 of FIG. 4. FIG. 5 illustrates how a single rotor 439 may be coupled to multiple rollers 438 or shoes and configured to interact with two working fluid flow paths. In one exemplary process, pressure may be input at the stage 420 at the first pump inlet 432*a*. The input pressure may thus induce flow through the first flexible member 436*a*, thereby causing the rotor 439 to rotate due to the interaction of the first flexible member 436*a* and the rollers 438 of the rotor 439. Rotation of the rotor 439 may then induce flow from the second pump inlet 432*b* to the second pump outlet 434*b* due to the interaction of the rollers 438 with the second flexible member 436*b*.

Additionally, referring to both FIG. 4 and FIG. 5, the system 400 may be configured such that pressure input at the first system inlet 412*a* induces pressure output at the second system outlet 414*b*. Similarly, the system 400 may be configured such that pressure input at the second system inlet 412*b* induces pressure output at the first system outlet 414*a*. In some embodiments the pressure input causes the rotors 439 of each stage 420 to rotate, thereby inducing pressure in the other working fluid flow path.

Further, the system 400 may be configured to be operated by powering the rotor 439 by inputting rotational displacement work into the system 400, by introducing pressure or flow into one working fluid flow path, by introducing pressure or flow into both working fluid flow paths, or by any combination of these inputs. In some embodiments the system 400 may be configured with a continuously variable transmission to adjust for changes in the input rotation as the pressure inputs change. Further, in certain embodiments, rotational displacement may only be introduced to overcome any losses (for example frictional losses) in the system 400 or to initially prime the system 400.

The system 400 may be configured such that the first working fluid pressure change across a particular pump 430 is substantially the same as the second working fluid pressure change across the same pump 430. In some such embodiments, the low-side first working fluid pressure may substantially equal the low-side second working fluid pressure, while the high-side first working fluid pressure may also substantially equal the high-side second working fluid pressure of a particular pump 430 of the system 400.

In some embodiments, the system 400 may be configured to recover a pressure output from a separate process. For example, pressure may be produced as a byproduct of a secondary process, and the system 400 may use such pressure at an input at one system inlet 412*a*, 412*b* while operation of the system 400 generates pressure in the other working fluid flow path. The pressure generated may then be used as an input in the secondary process or in a tertiary process.

The system 400 may further be configured with pressure chambers 440, working fluid connection segments 415, pressure envelopes, and a pressure barrier 450 analogous to the similarly named components described in connection with FIGS. 1-3, above. Additionally, stages 420 of the system 400 may be configured to be removed or bypassed and may comprise rotors 439 and flexible portions 436*a*, 436*b* analogous to the disclosure of these concepts and components recited above. Disclosure relative to these concepts recited above is analogously applicable to the two-sided embodiment of FIGS. 4 and 5. Moreover, disclosure above relating to the single working fluid flow path of the embodiments of FIGS. 1-3 may be applied to the first working fluid flow path, the second working fluid flow path, or both the first and second working fluid flow paths of the embodiment of FIGS. 4 and 5.

In embodiments wherein the pressure chambers 440 are pressurized by interaction between a regulator and a working fluid flow path, the regulator may be in communication with either the first or second working fluid of the system 400 of FIGS. 4 and 5. Additionally, in some embodiments the working fluid flow paths may be arranged as double helixes, including helixes disposed on the inside diameter of a tubular pressure barrier 450.

The system 400 may further be configured to be operated by rotational displacement input into the system 400. Rotational displacement may be input by any systems, components, or processes described in connection with the embodiments of FIGS. 1-3. For example, drive shafts may cross the pressure barrier 450, the rotors may be magnetically or electrically driven, drive motors may be disposed within the pressure chambers 440, and so forth. Additionally, the system 400 may be configured with a plurality of output shafts configured to transfer rotational displacement out of the system 400 in instances wherein pressure is input into the system 400 at one or both system inlets 412*a*, 412*b*. Any of the mechanisms or designs described in connection with inputting rotational displacement into the system may be analogously utilized to transfer rotational displacement out of the system. For example, shafts may cross the pressure barrier 450, or components outside the pressure barrier may be magnetically or electrically coupled to the rotors 439 of the system 400.

Figure 6:
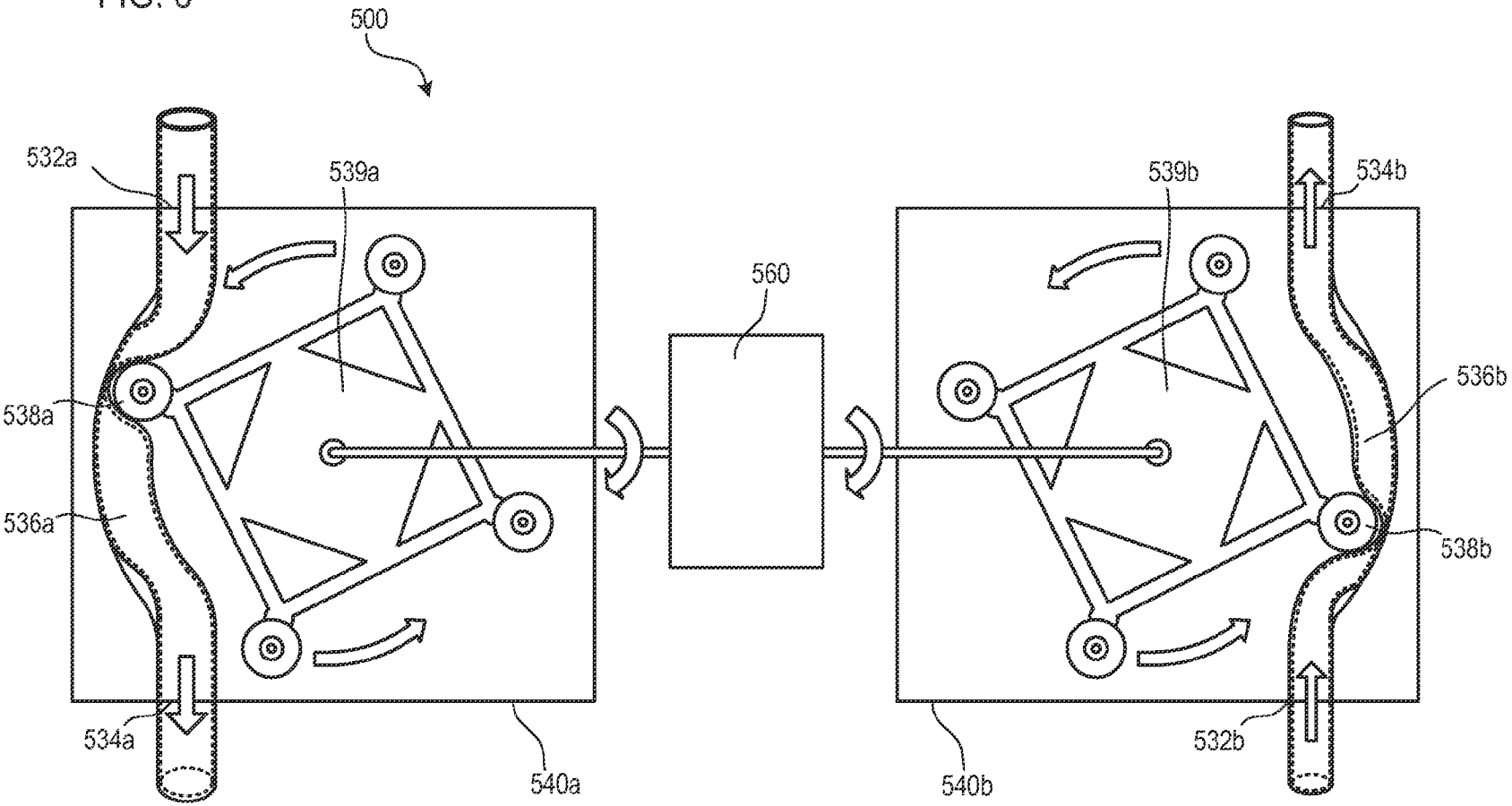
FIG. 6 is a schematic illustration of another embodiment of a portion of a peristaltic pump system comprising two working fluid flow paths.

FIG. 6 is a schematic illustration of another embodiment of a portion of a peristaltic pump system 500 comprising two working fluid flow paths. Disclosure recited in connection with FIGS. 4 and 5 may be analogously applied to the system of FIG. 6. In the embodiment of FIG. 6, in comparison to the embodiment of FIGS. 4 and 5, each working fluid flow path is associated with its own rotor 539*a*, 539*b*, rather than both working fluid flow paths being associated with the same rotor (439 of FIG. 5).

In the illustrated embodiment, a first working fluid may be displaced along a fluid flow path extending from a first pump inlet 532*a*, along a first flexible portion 536*a* to a first pump outlet 534*a*. A first rotor 539*a* and first set of rollers 538*a* may interact with the first working fluid. The first rotor 539*a* may be coupled to a second rotor 539*b* associated with the second pump. The second pump may be configured to interact with a second working fluid displaced between a second pump inlet 532*b* and a second pump outlet 534*b* along a second flexible portion 536*b*. The second pump may also comprise a second set of rollers 538*b* associated with the second rotor 539*b*. The first and second pumps may each be associated with separate pressure chambers 540*a*, 540*b*.

The first rotor 539*a* may be coupled to the second rotor 539*b* through a coupling portion 560 configured to transfer rotational displacement between the first and second rotors 539*a*, 539*b*. In some embodiments the coupling portion 560 may comprise a transmission. For example, the coupling portion 560 may comprise a fixed ratio transmission, a selectable ratio transmission, or a continuously variable transmission. Additionally, the coupling portion 560 may comprise a differential configured to transfer power into the system 500 from an external source. The system 500 may be configured to automatically adjust to changes in input pressure or changes in which side of the system is driven by pressure and which side is producing pressure through rotational displacement of the rotor.

The cross sectional area of the flow path associated with each side of the system 500 may or may not be the same. For example, the cross section of the first flexible portion 536*a* may be smaller or larger than the cross section of the second flexible portion 536*b*. The continuously variable transmission, or other components or characteristics of the system 500, may be configured such that the product of the pressure change times the flow rate for each side of each stage has the same magnitude at steady-state operation, notwithstanding differences in pressure change, flow rate, or cross sectional area between the first and second sides of each stage.

Methods are also contemplated in connection with the two-sided systems and elements disclosed above. Disclosure recited in connection with any system herein may be analogously applied to any method. An exemplary method relating to the systems discussed above may comprise displacing a first working fluid in stages along a first working fluid flow path and displacing a second working fluid in stages along a second working fluid flow path, wherein the first and second working fluids are displaced by peristaltic pumps configured such that the first or second working fluid pressure differential across a single pump is less than the first or second working fluid pressure differential across the system.

Without further elaboration, it is believed that one skilled in the art can use the preceding description to utilize the present disclosure to its fullest extent. The examples and embodiments disclosed herein are to be construed as merely illustrative and exemplary and not a limitation of the scope of the present disclosure in any way. It will be apparent to those having skill in the art, having the benefit of this disclosure, that changes may be made to the details of the above-described embodiments without departing from the underlying principles of the disclosure herein.

The invention claimed is:

1. A staged peristaltic pump system configured to displace a working fluid, the system comprising:

a system inlet;

a system outlet;

a plurality of peristaltic pumps disposed in series between the system inlet and the system outlet, each peristaltic pump comprising a rotor which rotates to displace the working fluid;

the plurality of peristaltic pumps configured such that a working fluid pressure change across any single pump is approximately the same as the working fluid pressure change across any other pump in the plurality of peristaltic pumps;

a plurality of pressure chambers, wherein each pressure chamber of the plurality of pressure chambers is configured to enclose a single pump of the plurality of peristaltic pumps and to maintain an internal pressure therein to be greater than the pressure of an external environment;

wherein each said pressure chamber of the plurality of pressure chambers is configured to maintain the internal pressure to be different from the internal pressure within the other pressure chambers, and wherein at least one working fluid pump inlet and at least one working fluid pump outlet are configured to cross at least one wall of the pressure chamber.

2. The staged peristaltic pump system of claim 1, wherein the work done over a time interval by any single pump, when the staged peristaltic pump system is operation, is approximately equal to the work done by any other pump of the plurality of peristaltic pumps over the same time interval.

3. The staged peristaltic pump system of claim 1, wherein the power consumption by any single pump, when the staged peristaltic pump system is in operation, is approximately equal to the power consumption by any other pump of the plurality of peristaltic pumps over the same time interval.

4. The staged peristaltic pump system of claim 1, wherein the system automatically adjusts such that the working fluid pressure change across any single pump, when the peristaltic pump system is in operation, is approximately the same as the working fluid pressure change across any other pump in the plurality of peristaltic pumps.

5. The staged peristaltic pump system of claim 1, wherein the plurality of peristaltic pumps comprises at least three peristaltic pumps, and wherein the plurality of pressure chambers comprises at least three pressure chambers.

6. The staged peristaltic pump system of claim 1, wherein each peristaltic pump is configured such that a pressure differential of the working fluid across a single peristaltic pump is smaller than the working fluid pressure differential between the system inlet and the system outlet.

7. The staged peristaltic pump system of claim 1, further comprising a drive mechanism and wherein the system is configured such that rotational displacement input to the rotors of the peristaltic pumps in the staged peristaltic pump system results in increased working fluid pressure between the system inlet and system outlet.

8. The staged peristaltic pump system of claim 7, wherein the drive mechanism comprises a plurality of independent motors, each motor coupled to a pump of the plurality of peristaltic pumps.

9. The staged peristaltic pump system of claim 7, wherein the drive mechanism comprises a single motor coupled to each pump of the plurality of peristaltic pumps.

10. The staged peristaltic pump system of claim 7, further comprising a pressure barrier configured to seal the system from fluid communication with an ambient environment and wherein the drive mechanism does not mechanically cross the pressure barrier.

11. The staged peristaltic pump system of claim 10, wherein the drive mechanism is disposed outside the pressure barrier.

12. A method of increasing the pressure of a working fluid in a staged peristaltic pump system, the method comprising:

displacing the working fluid in stages along a flow path from a system inlet to a system outlet, wherein the working fluid is displaced by a plurality of peristaltic pumps disposed in series between the system inlet and the system outlet, each peristaltic pump comprising a rotor which rotates to displace the working fluid the plurality of peristaltic pumps configured such that a working fluid pressure change across any single pump is approximately the same as the working fluid pressure change across any other pump in the plurality of peristaltic pumps;

wherein every single peristaltic pump in the system further comprises a pressure chamber enclosing the peristaltic pump and maintains an internal pressure therein to be greater than the pressure of an external environment;

wherein each said pressure chamber is configured to maintain the internal pressure to be different from the internal pressure within the other pressure chambers, and wherein at least one working fluid pump inlet and at least one working fluid pump outlet are configured to cross at least one wall of the pressure chamber.

13. The method of claim 12, wherein the work done over a time interval by any single pump, when the staged peristaltic pump system is in operation, is approximately equal to the work done by any other pump of the plurality of peristaltic pumps over the same time interval.

14. The method of claim 12, wherein the power consumption by any single pump, when the stage peristaltic pump system is in operation, is approximately equal to the power consumption by any other pump of the plurality of peristaltic pumps over the same time interval.

15. The method of claim 12, further comprising inputting rotational displacement into the plurality of peristaltic pumps to displace the working fluid.

16. The method of claim 15, further comprising priming the system.

17. The method of claim 16, wherein priming the system comprises inputting rotational displacement into the system.

18. The method of claim 16, wherein priming the system further comprises inputting pressure into the system.

19. The method of claim 12, wherein the plurality of peristaltic pumps comprises at least three peristaltic pumps.

* * * * *